US008561320B2

(12) United States Patent
Geer et al.

(10) Patent No.: US 8,561,320 B2
(45) Date of Patent: Oct. 22, 2013

(54) SYSTEM AND METHOD FOR DETERMINING STATUS OF A DRYING CYCLE AND FOR CONTROLLING A DRYER

(75) Inventors: David John Geer, Johnsonburg, PA (US); Jason John Detsch, St. Mary's, PA (US); Bradley McKay Johnson, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 229 days.

(21) Appl. No.: 13/222,434

(22) Filed: Aug. 31, 2011

(65) Prior Publication Data

US 2013/0047459 A1 Feb. 28, 2013

(51) Int. Cl.
*F26B 3/00* (2006.01)

(52) U.S. Cl.
USPC ..... 34/491; 34/524; 34/528; 8/137; 8/159; 68/18 R; 700/208; 134/172

(58) Field of Classification Search
USPC ..... 34/381, 413, 467, 497, 191, 524, 527, 34/528; 68/5 C, 18 R; 8/137, 159; 700/208; 134/56 R, 172
See application file for complete search history.

(56) References Cited

U.S. PATENT DOCUMENTS

| | | | | | |
|---|---|---|---|---|---|
| 4,198,763 | A | * | 4/1980 | Kurihara | 34/409 |
| 4,549,362 | A | * | 10/1985 | Haried | 34/395 |
| 4,649,654 | A | * | 3/1987 | Hikino et al. | 34/493 |
| 4,704,805 | A | * | 11/1987 | Kaya et al. | 34/483 |
| 5,050,313 | A | * | 9/1991 | Wakaeya et al. | 34/454 |
| 5,560,124 | A | * | 10/1996 | Hart et al. | 34/493 |
| 5,718,060 | A | * | 2/1998 | Mori | 34/446 |
| 5,755,041 | A | * | 5/1998 | Horwitz | 34/491 |
| 7,306,764 | B2 | | 12/2007 | Mody | |
| 7,322,126 | B2 | | 1/2008 | Beaulac | |
| 7,478,486 | B2 | | 1/2009 | Wunderlin et al. | |
| 7,762,007 | B2 | | 7/2010 | Guinibert et al. | |
| 7,770,305 | B1 | | 8/2010 | Krauss | |
| 7,971,371 | B2 | | 7/2011 | Beaulac | |
| 7,975,401 | B2 | | 7/2011 | Beaulac | |
| 2006/0179676 | A1 | * | 8/2006 | Goldberg et al. | 34/77 |
| 2007/0220776 | A1 | * | 9/2007 | Guinibert et al. | 34/603 |
| 2011/0289796 | A1 | * | 12/2011 | Ha et al. | 34/468 |
| 2012/0017465 | A1 | * | 1/2012 | Beers et al. | 34/493 |
| 2012/0297638 | A1 | * | 11/2012 | McLaren et al. | 34/409 |
| 2013/0047459 | A1 | * | 2/2013 | Geer et al. | 34/467 |
| 2013/0091726 | A1 | * | 4/2013 | Kim et al. | 34/427 |

FOREIGN PATENT DOCUMENTS

| | | | | |
|---|---|---|---|---|
| FR | 2696196 | A1 | * | 4/1994 |
| GB | 2291437 | A | * | 1/1996 |
| JP | 59228920 | A | * | 12/1984 |
| JP | 2012024403 | A | * | 2/2012 |

* cited by examiner

*Primary Examiner* — Steve M Gravini
(74) *Attorney, Agent, or Firm* — Hiscock & Barclay LLP

(57) ABSTRACT

A method for determining status of a drying cycle comprises receiving, at a first time, a first signal from a bladder pressure sensor configured to be responsive to changes in a weight of a container of the dryer, the container retaining materials to be dried. At a second time, the controller receives a second signal from the bladder pressure sensor. A change in the bladder pressure signals is calculated based on difference between the second signal and the first signal, and the change in the bladder pressure signals is interpreted as a change in the weight of the container. Based on the change in the weight of the container and the length of time, a rate of change in the weight of the container is calculated.

20 Claims, 4 Drawing Sheets

SYSTEM AND METHOD FOR DETERMINING STATUS OF A DRYING CYCLE AND FOR CONTROLLING A DRYER

BACKGROUND OF THE INVENTION

The subject matter disclosed herein relates generally to dryers and, more specifically, to systems and methods for determining a status of a drying cycle and for controlling a dryer.

Appliances for drying articles, such as laundry dryers or other machines for removing moisture (or other substances) from articles, typically comprises a cabinet containing a rotating container for tumbling the articles therein. A blower provides a stream of air for circulating through the articles in the container. One or more heating elements increases the temperature of the incoming air prior to its introduction to the container, causing the incoming air to carry a relatively low level of humidity. The warm, relatively dry air is circulated through the container as it tumbles the articles, decreasing the water content therein while increasing the relative humidity of the circulating air. The humidified air is then exhausted from the container and replaced with more heated, relatively dry air, whereby moisture is effectively removed from the articles in the container.

At least one known laundry dryer utilizes an open loop control system to determine an appropriate amount of time for drying a load of laundry. In this common system, an operator selects a desired drying time using a manual control, such as a time selector knob. For the duration of the selected drying time, the container is rotated, a blower removes air from the container, and heating elements add heat to produce a stream of warm, dry air entering the container. As long as moisture remains in the articles in the container, moisture is available for uptake by the circulating air, and the exhaust air will carry more humidity than the incoming air. When the articles in the container have released most or all of their available moisture, the circulation of warm, dry air inside the container will remain warm and dry, and the exhaust air will also be warm and dry. Absent means for detecting the completion of the goal of drying the articles, the open loop control system will continue to operate the laundry dryer until the prescribed period of time has elapsed. In some cases, this period of time is insufficient to remove all of the excess moisture from the articles. In other situations, the period of time may be too long and the articles dried more than the user desires.

Moreover, these drawbacks are not limited to laundry dryers; they also occur in systems for removing moisture from articles other than laundry articles. Still further, they occur in systems for removing substances other than water (e.g., alcohol, naphthalene, turpentine, dry-cleaning fluid, solvents, or other substances) from articles to be "dried".

Based on the foregoing, those skilled in the art seek improved systems and methods for determining a status of a drying cycle and for controlling a dryer.

BRIEF DESCRIPTION OF THE INVENTION

According to one aspect of the invention, a method for determining a status of a drying cycle and for controlling a dryer comprises initiating operation of the dryer and, at a first time, receiving a first bladder pressure signal from one or more bladder pressure sensors configured and positioned so as to be responsive to changes in a weight of a container that retains the materials that are to be dried. At a second time occurring a finite time interval later than the first time, a second bladder pressure signal is received from the one or more bladder pressure sensors. A change in the bladder pressure signals is calculated based on difference between the second bladder pressure signal and the first bladder pressure signal, and the change in the bladder pressure signals is interpreted as a change in the weight of the container. Based on the change in the weight of the container and the length of the finite time interval, a rate of change in a weight of the container is calculated.

According to another aspect of the invention, a system for determining a status of a drying cycle and for controlling a dryer that is configured for separating a first substance from materials retained in a container comprises a controller configured to receive, at a first time, a first bladder pressure signal from one or more bladder pressure sensors configured and positioned so as to be responsive to changes in a weight of the container. The controller is also configured to receive, at a second time occurring a finite time interval later than the first time, a second bladder pressure signal from the one or more bladder pressure sensors. The controller is configured to calculate a change in the bladder pressure signal based on difference between the second bladder pressure signal and the first bladder pressure signal and to interpret the change in the bladder pressure signal as a change in the weight of the container. Finally, the controller is configured to calculate a rate of change in the weight of the container based on the change in the weight of the container and the length of the finite time interval.

Accordingly, the invention provides an improved system and method for determining a status of a drying cycle and for controlling a dryer. These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
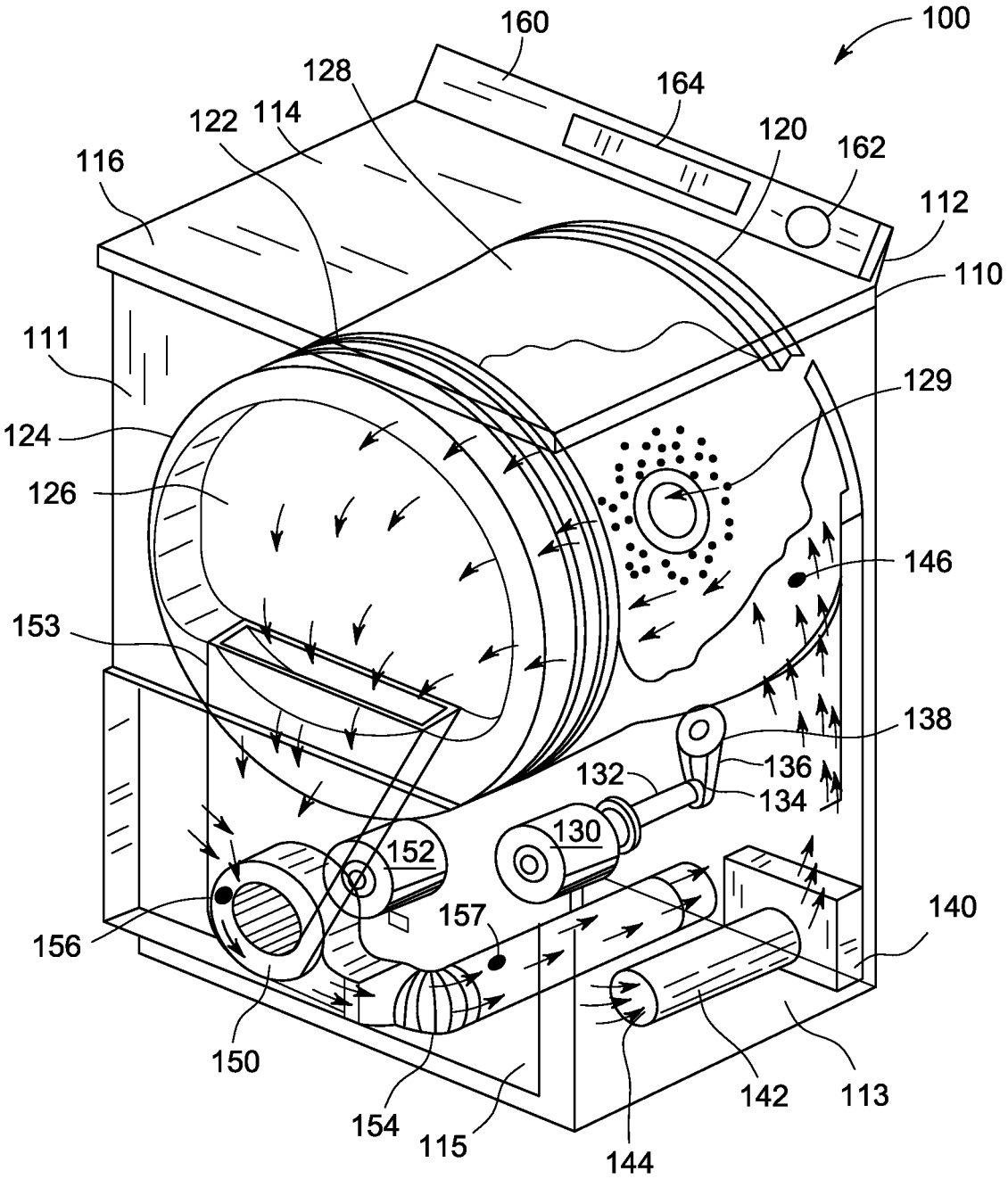
FIG. 1 is a perspective cutaway view of an exemplary dryer.

FIG. 1 illustrates an exemplary laundry dryer 100 in which the systems and methods described herein may be practiced. While described in the context of a specific embodiment of laundry dryer 100, it is recognized that the benefits of these systems and methods may be implemented in other types and embodiments of drying appliances. Therefore, the following description is set forth for illustrative purposes only, and the methods and apparatus described herein are not intended to be limited in practice to a specific embodiment of a laundry dryer, such as laundry dryer 100. Rather, the methods and apparatus described herein are intended to apply to drying systems and methods generally, which may include any combination of blowing and heating and tumbling or spinning (e.g., centrifuging) operations or any other operations useful for separating a first substance from a second substance or object.

As used herein, the term "drying" refers to the separation of a first substance from a second substance or object, such as through a process of vaporization or sublimation of the first substance or through mechanical separation (e.g., centrifuging). Similarly, as used herein, the term "dryer" refers to a machine configured for separating a first substance from a second substance or object, such as through a process of vaporization or sublimation of the first substance or through mechanical separation (e.g., centrifuging).

As shown in FIG. 1, laundry dryer 100 includes a cabinet 110 including a front panel 111, a rear panel 112, a pair of side panels 113 and 114 spaced apart from each other by front panel 111 and rear panel 112, a bottom panel 115, and a top cover 116. Within cabinet 110 is a container 120, which is configured as a drum mounted for rotation about a substantially horizontal axis. It should be noted that in an alternative embodiment, container 120 may be mounted for rotation about a substantially vertical axis and may include a number of holes in its exterior wall to facilitate separation of liquids through spinning (i.e., centrifuging). A motor 130 provides a means for rotating container 120 about its horizontal axis. More specifically, in the embodiment shown in FIG. 1, a motor 130 drives a shaft 132, which drives a pulley 134, which drives a belt 136, which drives a roller 138, which causes container 120 to rotate, tumbling articles in the container. Motor 130, shaft 132, pulley 134, belt 136, and roller 138 are positioned (e.g., to the side of container 120) so as to avoid imposing non-steady forces on container 120 that could affect detection of changes in weight of container 120 including its contents.

In this embodiment, container 120 is generally cylindrical in shape, having an outer cylindrical wall 122 and a front flange 124 defining an opening 126 to container 120 for loading and unloading of materials to be dried such as laundry articles. At front flange 124, container 120 is supported by a cooperating lip 117 of front panel 111. Container 120 includes a rear wall 128 that is supported for rotation within the main housing 110 by a suitable fixed bearing. Rear wall 128 defines a plurality of holes 129 that receive hot air that has been heated by an electrical heater 140 that is in communication with an air supply duct 142 having a duct inlet 144. An inlet air temperature sensor 146 is configured and positioned to sense the temperature of heated air entering container 120.

The heated air is drawn from the container 120 by a blower fan 150 which is driven by a blower motor 152. The air passes through a filter 153 which traps any lint particles. As the air passes through the filter 153, it is passed out of the laundry dryer through an exhaust duct 154. An exhaust air temperature sensor 156 is configured and positioned to sense the temperature of air exiting container 120. An exhaust air pressure sensor 157 is configured and positioned to sense the pressure of air exiting container 120 via exhaust duct 154. After the materials have been dried, they may be removed from container 120 via opening 126.

A cycle selector knob 162 is mounted on a cabinet backsplash 160 and is in communication with a control system 164. Signals generated in control system 164 operate container 120 and heating elements 140 in response to a position of selector knob 162 and feedback signals received from various sensors configured and positioned to monitor performance and operation of laundry dryer 100. Blower motor 152 is also controlled by control system 164.

Figure 2:
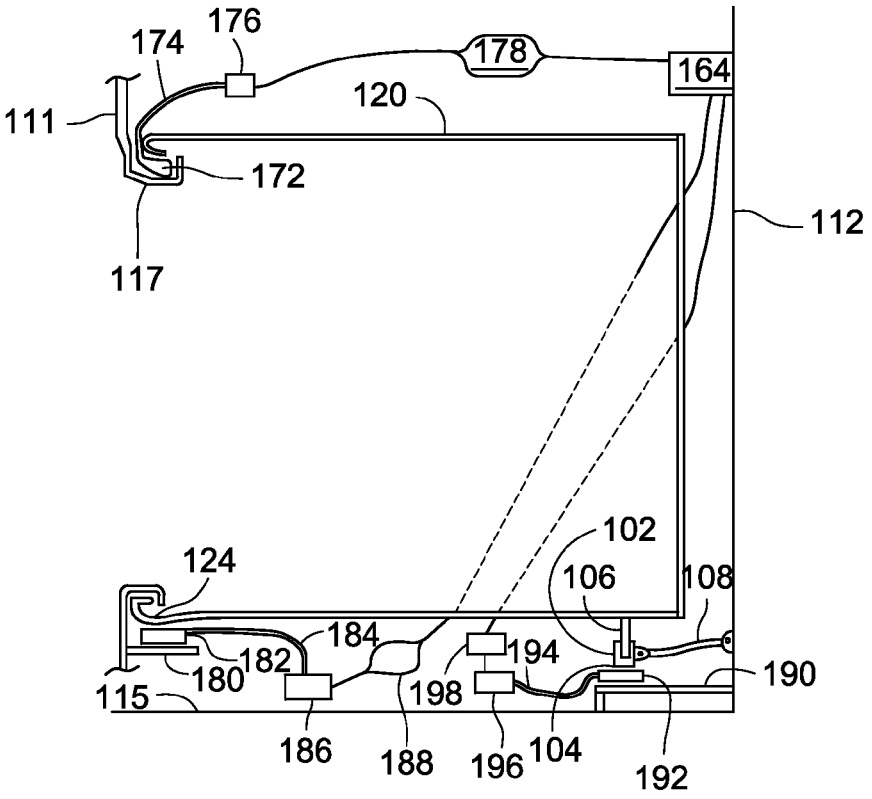
FIG. 2 is a side cutaway view of a dryer showing bladder sensor instrumentation useful for determining status of a drying cycle and for controlling a dryer.

Control system 164 receives signals provided by instrumentation that is configured to sense changes in the weight of container 120 during operation of dryer 100. In an exemplary embodiment, as shown in FIG. 2, relative weight signals are generated by one or more pressure sensor 176, the signals being indicative of pressure in a pressure sensitive bladder 172 on which container 120 is supported. Pressure sensitive bladder 172 is positioned and configured so that its internal pressure is responsive to changes in the weight of container 120 and so that pressure of the fluid contained in pressure sensitive bladder 172 is indicative of relative weight in container 120. Pressure sensitive bladder 172 is constructed and configured so as to deform as the weight of container 120 changes. In an exemplary embodiment, pressure sensitive bladder 172 is constructed of metal such as stainless steel or brass. In another exemplary embodiment, pressure sensitive bladder is constructed of a polymer and or of other materials such as carbon or glass reinforced composite material. In one embodiment, the control system 164 is configured to receive the relative weight signals only when the container 120 is stationary so as to minimize errors in the weight signals that might otherwise be caused by forces imposed on the container 120 by the roller 138 or other apparatus that is configured to rotate the container 120.

As water (or another substance to be removed) is removed from the materials in container 120, the weight of those materials decreases, and the weight of container 120, which contains those materials, also decreases. As the materials become dry, and the rate of drying (i.e., the rate at which water is extracted from the materials) decreases, the weight of container 120 also decreases. Moreover, as the moisture remaining in the articles is depleted, the rate, at which the weight of container 120 decreases, also decreases. Since the pressure sensors are configured and positioned so as to be responsive to changes in the weight of container 120, the control system 164 is enabled to monitor and respond to changes in both the weight of container 120 and the rate of change in the weight of container 120. So as to enable the control system 164 to monitor and respond to rates of change in monitored parameters, control system 164 enjoys access to a reference time (or relative time) signal.

In an exemplary embodiment, control system 164 also receives signals provided by instrumentation that is configured to sense the temperature of heated air entering container 120 and the temperature of air exiting container 120 during operation of dryer 100. As water (and/or other substances) is extracted from the materials in container 120, the air circulating in the container is cooled such that the temperature of the air exiting the container 120 is cooler than the temperature of the air entering the container 120. The difference in temperatures is indicative of the quantity of water (or other substances) extracted from the materials.

When the materials become dry, and the rate at which water is extracted decreases, and the difference between the temperatures of air entering and exiting the container 120 (i.e., the container air temperature difference) also decreases. Moreover, the rate of change of the temperature difference also decreases. The temperature sensors are configured and positioned so as to be responsive to changes in the difference between the temperatures of air entering and exiting container 120. Accordingly, the control system is enabled to monitor and respond to changes in both the difference between the temperatures of air entering and exiting the container 120 and/or the rate of change in the difference between the temperatures of air entering and exiting the container 120.

In an exemplary embodiment, control system 164 also receives signals provided by instrumentation that is configured to be indicative of a rate of flow of air through container 120, such as a pressure sensor 157 positioned to sense the pressure of air in outlet duct 154. Accordingly, the control system 164 is enabled to monitor and respond to changes in the flow rate of air passing through the container 120 and/or the rate of change of the flow rate of air passing through the container 120.

With reference to FIG. 2, lip 117 of front panel 111 of dryer 100 supports pressure sensitive bladder 172 on which front flange 124 of container 120 is supported. Pressure sensitive bladder 172 is positioned and configured so that its internal pressure is responsive to changes in the weight of container 120 and so that pressure of the fluid contained in pressure sensitive bladder 172 is indicative of relative weight in container 120. Pressure sensitive bladder 172 is coupled to pressure line 174, which transmits a pressure signal (i.e., pressurized fluid) from pressure sensitive bladder 172 to a front container upper bladder pressure sensor 176. Pressure sensor 176 is operable to produce a pressure signal 178 indicative of changes in fluid pressure within bladder 172. Pressure signal 178 is communicated to control system 164 for use in determining a status of a drying cycle (e.g., dryness of materials relative to a desired level of dryness) and for controlling a dryer, such as a laundry dryer.

One or more bladder support platforms 180 are supported by front panel 212 beneath container 220. Bladder support platforms 180 each support one or more additional pressure sensitive bladders 182, on which front flange 124 of container 120 is supported. Pressure sensitive bladders 182 are positioned and configured so that their internal pressures are responsive to changes in the weight of container 120 and so that pressure of the fluid contained in pressure sensitive bladders 182 are indicative of relative weight in container 120. Since container 120 may rotate during operation, each pressure sensitive bladder 172, 182 may be positioned so as to rest under one or more slide bearing positioned so as to protect both container 120 and structure that supports container 120. In an exemplary embodiment, a slide bearing comprises a polymer configured and arranged so as to protect a pressure sensitive bladder from wear. Accordingly, a pressure sensitive bladder rides under container 120 as it rotates. Changes in the weight of the container 120 cause corresponding changes in the pressure within the pressure sensitive bladder, thereby causing corresponding changes in the pressure signals transmitted to the pressure sensor 186.

For example, as a load of laundry dries inside an exemplary container 120, both the water content and weight of the laundry articles decreases, causing the pressure in the pressure sensitive bladder to decrease. This causes the pressure sensor to detect a decrease in pressure, which may be interpreted as a decrease in weight of the container and thus an indication of the level of dryness in the load of laundry. Pressure line 184 transmits a pressure signal from pressure sensitive bladder 182 to a front container lower bladder pressure sensor 186. Pressure sensor 186 is operable to produce a pressure signal 188 indicative of changes in fluid pressure within bladder 182. Pressure signal 188 is communicated to control system 164 for use in determining status of a drying cycle and for controlling a laundry dryer.

One or more bladder support platforms 190 are supported by rear panel 112 and/or bottom panel 115. Bladder support platforms 190 each support one or more additional pressure sensitive bladders 192, on which container 120 is supported at or near rear wall 128 of container 120 by one or more rolling container supports 102. Pressure sensitive bladders 192 are positioned and configured so that their internal pressure is responsive to changes in the weight of container 120 and so that pressure of the fluid contained in pressure sensitive bladders 192 are indicative of changes in weight in container 120.

In an exemplary embodiment, a fixed bearing supports the container 120 near its rotational axis. In accordance with this embodiment, changes in weight of container 120 are determined based on changes in pressure signals received from one or more pressure sensitive bladder positioned a finite distance away from the fixed bearing. For example, where a fixed bearing supports and thereby constrains vertical movement of a rear of the container 120, one or more pressure sensitive bladder may be positioned toward the apposing end of container 120, such as proximate the opening of container 120 so as to compress or expand as weight of container 120 changes.

Rolling container supports 102 each comprise a base 104 resting on a pressure sensitive bladder 192. Each base 104 supports a wheel 106 on which container 120 rides. Each base is constrained by one or more stabilizer 108 so that each wheel 106 rotates about an axis that is substantially parallel to the axis about which container 120 rotates. Pressure line 194 transmits a pressure signal from pressure sensitive bladder 192 to a rear container bladder pressure sensor 196. Pressure sensor 196 is operable to produce a pressure signal 198 indicative of changes in fluid pressure within bladder 192. Pressure signal 198 is communicated to control system 164 for use in determining status of a drying cycle and for controlling a laundry dryer. As one skilled in the art will appreciate, sliding configurations are contemplated wherein wheel 106 is replaced by one or more slide bearings.

As one skilled in the art will appreciate, it may be desirable in some embodiments to manifold some or all of the pressure lines 274, 284, and/or 294 together so as to obtain a combined, or averaged, pressure reading. In other embodiments, it may be desirable to obtain individualized pressure signals associated with specific pressure sensitive bladders.

Figure 3:
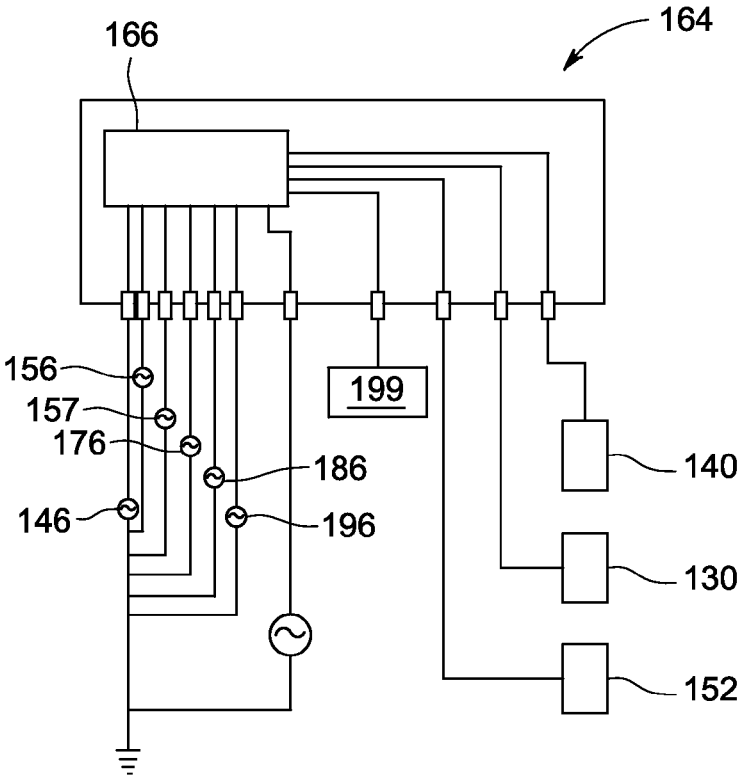
FIG. 3 is a schematic diagram of a controller control circuit for determining status of a drying cycle and for controlling a dryer.

FIG. 3 is a schematic block diagram of control system 164 including a controller 166 which is in communication with inlet air temperature sensor 146, exit air temperature sensor 156, exhaust duct air pressure sensor 157, front container upper bladder pressure sensor 176, front container lower bladder pressure sensor 186, and rear container bladder pressure sensor 196. Controller 166 also is in communication with heater 140, container motor 130, blower motor 152 and feedback mechanism 199. In an exemplary embodiment, feedback is indicative of the status of drying, and mechanism 199 comprises a display and/or an alarm signal. Controller 166 is programmed to perform functions described herein, and as used herein, the term controller is not limited to just those integrated circuits referred to in the art as controllers, but broadly refers to microprocessors, computers, processors, microcontrollers, microcomputers, programmable logic controllers, application specific integrated circuits, field programmable gate arrays, and other programmable circuits, and these terms are used interchangeably herein.

In operation, a user selects a drying cycle through control system 164. Controller 166 then controls the blower motor 152, the container motor 130, the alarm 199, and the heater 140 in order to effectuate control over the blower fan, the container, the temperature of the air circulating in the container, and to alert a user of the dryer. Controller 166 contains multiple program algorithms associated with the drying options available to the user through control system 164. For example, in one drying cycle, controller 166 directs blower motor 152 and container motor 130 to each operate at constant speed and heater 140 to maintain a constant container inlet temperature until the rate of decrease in container weight falls below a preset level, wherein the preset level is configured and selected so as to correspond to a user-selected level of dryness for the materials to be dried. Upon achieving the preset level, controller 166 directs alarm 199 to sound and terminates the supply of heat through heater 140.

For another drying cycle, controller 166 directs blower motor 152 and container motor 130 and heater 140 to operate at a constant speed and to maintain a constant container inlet temperature until the rate of change of container air temperature difference falls below a preset level, wherein the preset level is configured and selected so as to correspond to a user-selected level of dryness for the materials to be dried. Upon achieving the preset level, controller 166 directs alarm 199 to sound and terminates the supply of heat through heater 140. For another drying cycle, controller 166 directs blower fan motor 148 and container motor 130 and heater 140 to operate until the rate of decrease in container weight and the container air temperature difference both fall below a preset level, wherein the preset level is configured and selected so as to correspond to a user-selected level of dryness for the materials to be dried.

In yet another drying cycle, controller 166 is programmed to regulate the operation of blower motor 152, the container motor 130, and the heater 140 based on a rate of change in weight of container 120. For example, as the rate of change in the weight of container 120 decreases, controller 166 may increase or decrease the speed of container 166 and/or the speed of the blower and/or the temperature of the inlet air. In one embodiment, controller 166 determines the rate of change in weight of container 120 based on a rate of change of pressure in a pressure sensitive bladder positioned under the front flange of the container. In another embodiment, controller 166 determines the rate of change in weight of container 120 based on a rate of change of pressure in a pressure sensitive bladder positioned under the front of the container. In yet another embodiment, controller 166 is programmed to determine the rate of change in weight of container 120 based on a rate of change of pressure in a pressure sensitive bladder positioned under the rear of the container.

Figure 5:
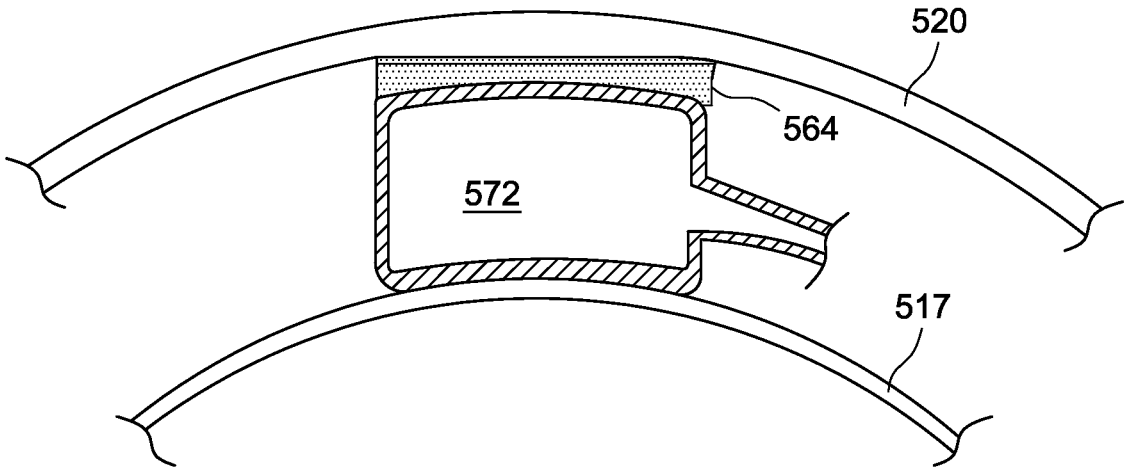
FIG. 5 is a side cutaway view of an exemplary pressure sensitive bladder.

FIG. 5 is a side cutaway view of an exemplary pressure sensitive bladder. As shown in FIG. 5, a cooperating lip 517 provides support for a pressure sensitive bladder 572. A container 520 rests upon a slide bearing 564 that is supported by pressure sensitive bladder 572. As weight of container 520 changes, the force exerted by container 520 upon slide bearing 564 and, thus, pressure sensitive bladder 572 changes correspondingly. As a result, pressure inside pressure sensitive bladder 572 also changes correspondingly. These changes in pressure can be monitored and interpreted as changes in the weight of container 520. In an exemplary embodiment, changes in weight of container 520 are interpreted as changes in dryness of articles contained in container 520.

Figure 4:
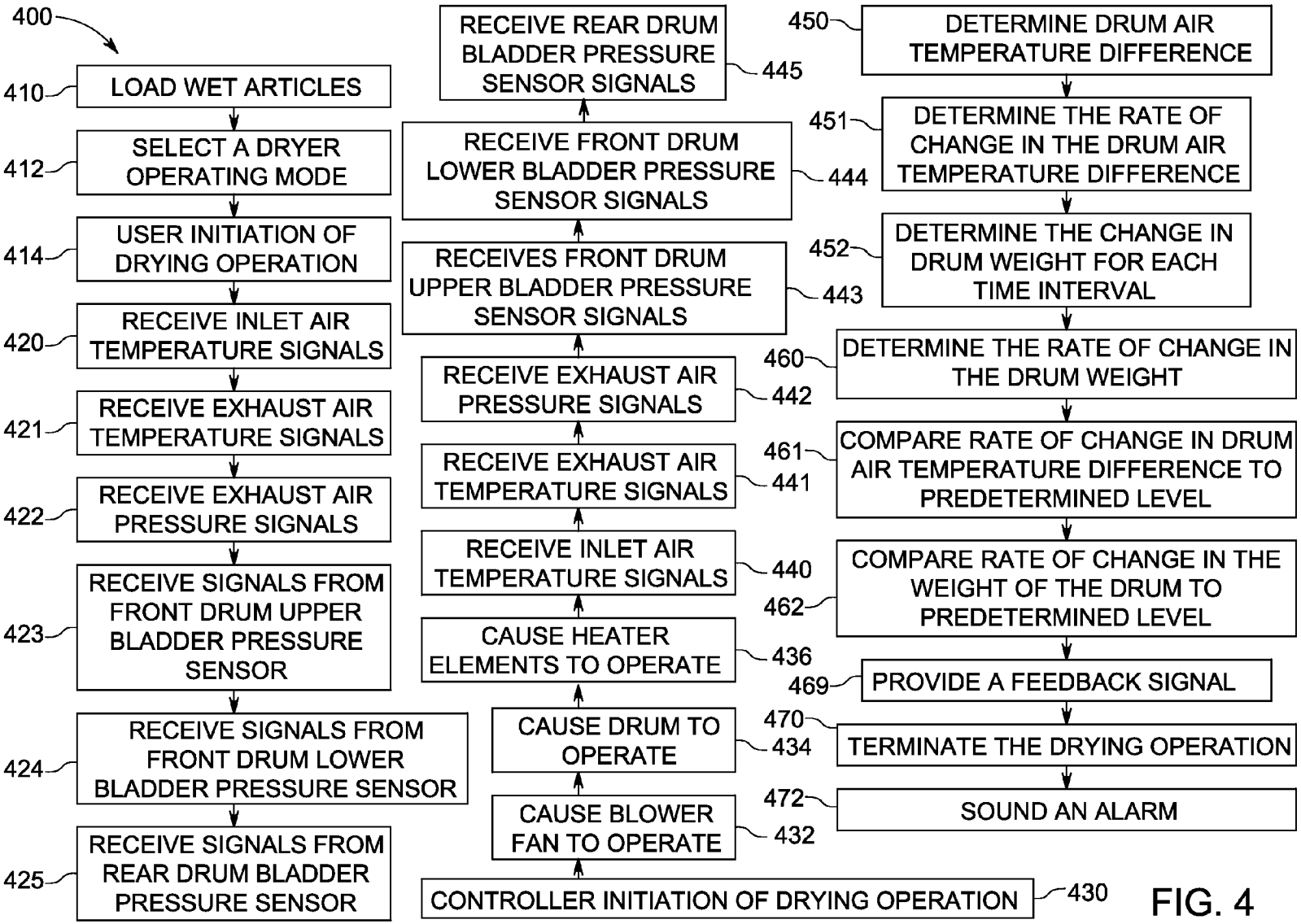
FIG. 4 a flow diagram of an exemplary process for determining a status of a drying cycle and for controlling a dryer.

FIG. 4 illustrates a flow diagram of a drying process 400. A user loads wet laundry articles or other materials to be dried into the dryer container (step 410), selects a dryer operating mode via the selector knob (step 412), and initiates operation of the drying operation (step 414). The controller receives signals from an inlet air temperature sensor (step 420) and interprets those signals as being indicative of the temperature of heated air entering the container. The controller receives signals from an exhaust air temperature sensor (step 421) and interprets those signals as being indicative of the temperature of air exiting the container. The controller receives signals from an exhaust air pressure sensor (step 422) and interprets those signals as being indicative of the pressure of air exiting container.

The controller receives signals from one or more front container upper bladder pressure sensor (step 423) and interprets those signals as being indicative of a relative pressure in a pressure sensitive bladder positioned beneath the front flange of the container and, therefore, the relative weight of the container. The controller receives signals from one or more front container lower bladder pressure sensor (step 424) and interprets those signals as being indicative of a relative pressure in a pressure sensitive bladder positioned beneath the front of the container and, therefore, the relative weight of the container. The controller receives signals from one or more rear container bladder pressure sensor (step 425) and interprets those signals as being indicative of a relative pressure in a pressure sensitive bladder positioned beneath the rear of the container and, therefore, the relative weight of the container.

The controller initiates the drying operation (step 430) by causing the blower fan (step 432) and the container (step 434) and the heater elements (step 436) to operate. While the dryer is operating, the controller receives additional signals from the inlet air temperature sensor (step 440). While the dryer is operating, the controller receives additional signals from the exhaust air temperature sensor (step 441). While the dryer is operating, the controller receives additional signals from the exhaust air pressure sensor (step 442). While the dryer is operating, the controller receives additional signals from the one or more front container upper bladder pressure sensor (step 443). While the dryer is operating, the controller receives additional signals from the one or more front container lower bladder pressure sensor (step 444). While the dryer is operating, the controller receives additional signals from the one or more rear container bladder pressure sensor (step 445).

Based on the signals received from the inlet air temperature sensor and the exhaust air temperature sensor, the controller determines the container air temperature difference (step 450). By repeating this calculation over incremental time intervals, the controller also determines the rate of change in the container air temperature difference (step 451). Based on the signals received from the various bladder pressure sensors over incremental time intervals, the controller determines the change in container weight for each time interval (step 460) and the rate of change in the container weight (step 461). The controller may provide a feedback signal such as by illuminating one or more colored lights indicating the status of the drying cycle, that status being based on the rate of change in the weight of the container (step 469). The controller compares the rate of change in container air temperature difference (step 452) and the rate of change in the weight of the container (step 462) against predetermined levels corresponding to inputs received from the user via the selector knob. When predetermined criteria are satisfied, the controller terminates the drying operation (step 470) and sounds an alarm to alert the user that the drying cycle is complete or has achieved a desired level of drying (step 472).

The embodiments thus described provide a dryer control for a laundry dryer with a variable speed blower motor and a variable heater element that allows the dryer to be operated in a manner that facilitates improving dryer efficiency, reducing energy consumption, and lowering drying time which also facilitates extending the useful life of the dryer.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. For example, while the invention has been illustrated through the described laundry dryer having a blower and a heater and a horizontally oriented container or drum, it should be appreciated that the invention may be similarly implemented in other systems and methods for separating a first substance from a second substance or object, such as through a process of vaporization or sublimation of the first substance or through mechanical separation (e.g., centrifuging), and such systems may not require the use of a blower and a heater and a horizontally oriented container or drum. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for determining status of a drying cycle and for controlling a dryer comprising:

a controller operatively coupled to a dryer that is configured for separating a first substance from materials retained in a container;

the controller configured to receive, at a first time, a first bladder pressure signal from one or more bladder pressure sensors configured and positioned so as to be responsive to changes in a weight of the container;

the controller configured to receive, at a second time occurring a finite time interval later than the first time, a second bladder pressure signal from the one or more bladder pressure sensors;

the controller configured to calculate a change in bladder pressure signal based on a difference between the second bladder pressure signal and the first bladder pressure signal;

the controller configured to interpret the change in the bladder pressure signal as a change in the weight of the container; and the controller configured to calculate a rate of change in the weight of the container based on the change in the weight of the container and the length of the finite time interval.

2. The system of claim 1, wherein the controller is further configured to provide feedback indicative of a status of drying, the status being based on the rate of change in the weight of the container.

3. The system of claim 1, wherein the controller is further configured to compare the rate of change in the weight of the container to a preset threshold.

4. The system of claim 1, wherein the controller is further configured to terminate operation of the dryer when the rate of change in the weight of the container falls below the preset threshold.

5. The system of claim 4, wherein the preset threshold is configured and selected so as to correspond to a user-selected level of dryness for the materials.

6. The system of claim 1, wherein the controller is further configured to:

receive a first container inlet temperature signal from one or more inlet air temperature sensors configured and positioned so as to be responsive to changes in a temperature of air entering the container;

receive, at the first time, a first container exhaust temperature signal from one or more exhaust air temperature sensors configured and positioned so as to be responsive to changes in a temperature of air exiting the container;

receive, at the second time, a second container inlet temperature signal from the one or more inlet air temperature sensors;

receive, at the second time, a second container exhaust temperature signal from the one or more exhaust air temperature sensors;

calculate a first container air temperature difference based on the first container inlet temperature signal and the first container exhaust temperature signal;

calculate a second container air temperature difference based on the second container inlet temperature signal and the second container exhaust temperature signal;

calculate a change in the container air temperature difference based on a difference between the first container air temperature difference and the second container air temperature difference; and calculate a rate of change in the container air temperature difference based on the change in the container air temperature difference and the length of the finite time interval.

7. The system of claim 6, wherein the controller is further configured to compare the rate of change in the container air temperature difference to a preset threshold and to terminate operation of the dryer when both the rate of change in the weight of the container and the rate of change in the container air temperature difference fall below preset thresholds.

8. A method for determining a status of a drying cycle and for controlling a dryer including a container for retaining materials to be dried, the method comprising:

initiating operation of the dryer;

receiving, at a first time, a first bladder pressure signal from one or more bladder pressure sensors configured and positioned so as to be responsive to changes in a weight of the container;

receiving, at a second time occurring a finite time interval later than the first time, a second bladder pressure signal from the one or more bladder pressure sensors;

calculating a change in bladder pressure signal based on difference between the second bladder pressure signal and the first bladder pressure signal;

interpreting the change in bladder pressure signal as a change in the weight of the container; and calculating a rate of change in the weight of the container based on the change in the weight of the container and the length of the finite time interval.

9. The method of claim 8, further comprising providing feedback indicative of the status of drying, the status being based on the rate of change in the weight of the container.

10. The method of claim 8, further comprising comparing the rate of change in the weight of the container to a preset threshold.

11. The method of claim 10, further comprising terminating operation of the dryer when the rate of change in the weight of the container falls below the preset threshold.

12. The method of claim 10, wherein the preset threshold is configured and selected so as to correspond to a user-selected level of dryness for the materials.

13. The method of claim 8, wherein the container is oriented horizontally for tumbling the materials.

14. The method of claim 8, wherein the container is oriented vertically for spinning the materials.

15. The method of claim 13, wherein the dryer includes a blower for circulating air through the materials in the container.

16. The method of claim 13, wherein the dryer includes a heater for heating the air.

17. The method of claim 8, further comprising:

receiving, at the first time, a first container inlet temperature signal from one or more inlet air temperature sensors configured and positioned so as to be responsive to changes in a temperature of air entering the container;

receiving, at the first time, a first container exhaust temperature signal from one or more exhaust air temperature sensors configured and positioned so as to be responsive to changes in a temperature of air exiting the container;

receiving, at the second time, a second container inlet temperature signal from the one or more inlet air temperature sensors;

receiving, at the second time, a second container exhaust temperature signal from the one or more exhaust air temperature sensors;

calculating a first container air temperature difference based on the first container inlet temperature signal and the first container exhaust temperature signal;

calculating a second container air temperature difference based on the second container inlet temperature signal and the second container exhaust temperature signal;

calculating a change in container air temperature difference based on a difference between the first container air temperature difference and the second container air temperature difference; and calculating a rate of change in container air temperature difference based on the change in the container air temperature difference and the length of the finite time interval.

18. The method of claim 17, further comprising comparing the rate of change in the container air temperature difference to a preset threshold.

19. The method of claim 18, further comprising terminating operation of the dryer when both the rate of change in the weight of the container and the rate of change in the container air temperature difference fall below the preset threshold.

20. The method of claim 18, wherein the preset threshold is configured and selected so as to correspond to a user-selected level of dryness for the materials.

* * * * *